US006446359B2

(12) United States Patent
Tomat

(10) Patent No.: US 6,446,359 B2
(45) Date of Patent: Sep. 10, 2002

(54) VENTILATED SHOE SALE STRUCTURE

(75) Inventor: Andrea Tomat, Montebelluna (IT)

(73) Assignee: Lotto Sport Italia S.p.A., Montebelluna (IT)

( * ) Notice: Subject to any disclaimer, the term of this patent is extended or adjusted under 35 U.S.C. 154(b) by 0 days.

(21) Appl. No.: 09/764,345

(22) Filed: Jan. 19, 2001

(30) Foreign Application Priority Data

Jan. 21, 2000 (IT) ..... TV000002 U

(51) Int. Cl.[7] ..... A43B 7/06; A43B 13/18; A43B 21/26

(52) U.S. Cl. ..... 36/3 R; 36/3 B; 36/28; 36/35 B

(58) Field of Search ..... 36/3 R, 3 B, 92, 36/29, 35 B, 30 R, 28, 35 R, 37

(56) References Cited

U.S. PATENT DOCUMENTS 616,112 A * 12/1898 Kennedy ..... 30/3 B
1,993,208 A * 3/1935 Cohn ..... 36/3 B
2,074,050 A * 3/1937 Dwyer ..... 36/35 R
4,438,573 A * 3/1984 McBarron ..... 36/3 B
4,888,887 A * 12/1989 Solow ..... 36/3 B
4,939,851 A * 7/1990 Miller ..... 36/3 B
5,299,368 A * 4/1994 Liu ..... 36/3 B
5,400,526 A * 3/1995 Sesa ..... 36/3 B
5,992,052 A * 11/1999 Moretti ..... 36/3 B
6,012,236 A * 1/2000 Pozzobon ..... 36/3 R

FOREIGN PATENT DOCUMENTS

EP 479183 * 4/1992 ..... 36/28

* cited by examiner

*Primary Examiner*—Anthony D. Stashick
(74) *Attorney, Agent, or Firm*—Browdy and Neimark, P.L.L.C.

(57) ABSTRACT

Sole structure able to associated to an upper of a shoe, having first ducts in the area of the plantar arch and of the tip and one or more lateral openings in the heel area. In the heel area is obtained a seat for a counter-shaped insert provided with at least an elastically compressible central area, inferiorly communicating with second ducts communicating in turn with third ducts obtained superiorly to the insert and communicating with the first ducts and with the openings, and through the interposition of a gasket permeable to air but not to water. The insert has an upper surface whereon is obtained a central area, elastically compressible and inferiorly communicating with a cavity, obtained on a lower surface of the insert, in such a way that to a deformation of the central area corresponds a variation of the volume of the cavity.

16 Claims, 3 Drawing Sheets

VENTILATED SHOE SALE STRUCTURE

BACKGROUND OF THE INVENTION

The present invention relates to a sole structure able to be associated to an upper of a shoe.

Nowadays, several known shoes present on the market have multiple systems and methods for aerating the interior part of the shoe.

Some known shoes partially achieved the assigned task by means of appropriate holes, for instance obtained on the upper.

Such solutions have the considerable disadvantage of allowing water infiltration inside the shoe.

The use, in correspondence with such holes, of possible layers of materials which are transpiring and impermeable at the same time does not completely solve the problem of achieving a good aeration of the shoe, since the exchange of air between the interior of the shoe and the environment is very limited.

In other known shoes, appropriate ducts are employed, for instance obtained on the upper surface of the sole, and advantageously communicating with the exterior, so that the air can be circulated in said ducts and reach the foot passing through an appropriate transpiring arch support, in contact with said sole.

The main disadvantage of this solution also consists in the possible infiltration of water in the interior of the shoe, which takes place through the ducts.

A further known shoe is constituted by an upper comprising a transpiring arch support, positioned superiorly to an impermeable sole.

Between said sole and the arch support is positioned an aerating device constituted by an air elastically deformable tank, through a first one-way valve, with an air diffuser element positioned in proximity to the metatarsus area and appropriately holed, in order to distribute air within the upper.

The tank is also connected to a second check valve positioned, for instance, laterally to the sole, able to draw air from the exterior.

The second check valve has a sufficiently small internal diameter to prevent water from entering, thereby guaranteeing impermeability.

This device functions while the user walks, since at each step, when the heel bears down on the ground, the tank is compressed, thereby sending air to the diffuser element.

After the foot is raised, the elastically deformable tank returns to its shape, thereby creating a vacuum that draws air from the exterior, through the second check valve.

The main drawback of this known shoe consists of the fact that it presents considerable construction complexity, having multiple delicate mechanisms in an area, the sole, that usually undergoes numerous strong stresses, with the risk that the aerating device may be subject to malfunctions or breakage.

Another disadvantage of this shoe stems from the high global cost, essentially due to the constructive complexity of the aeration device, to the work processes to be executed and to the need to assemble the various components of the sole at the end.

SUMMARY OF THE PRESENT INVENTION

The main aim of the present invention therefore is to solve the technical problems highlighted above, eliminating the drawbacks of the aforementioned prior art and thus devising an invention which allows to obtain a shoe that allows a good aspiration through the sole, whilst insuring a safe and effective impermeability.

Within the scope of the task set out above, another important aim is to obtain an invention that allows to achieve the specified aim by means of a simple and rugged aeration mechanism, thereby avoiding possible breakage or malfunctions.

Yet another important aim is to obtain an invention that achieves the specified aim without sacrificing the resistance and aesthetic quality of the shoe.

Not the least aim is to obtain an invention that is structurally simple, whilst also having low costs of production.

The aforementioned task and aims, as well as others that will become more readily apparent farther on, are achieved by a sole structure as described in the claims that follow.

BRIEF DESCRIPTION OF THE DRAWINGS

Further features and advantages of the invention shall become more readily apparent from the detailed description that follows of a particular embodiment, illustrated purely by way of non limiting indication in the accompanying drawing tables, in which.

DESCRIPTION OF THE PREFERRED EMBODIMENTS

With reference to the aforementioned figures, the reference number 1 indicates a shoe constituted by an upper 2 whereto is inferiorly associated a sole 6.

Advantageously, the sole 6 comprises superiorly an arch support 4, presenting a first and a second area, indicated with the numbers 5*a* and 5*b*, made of a transpiring material.

Figure 1:
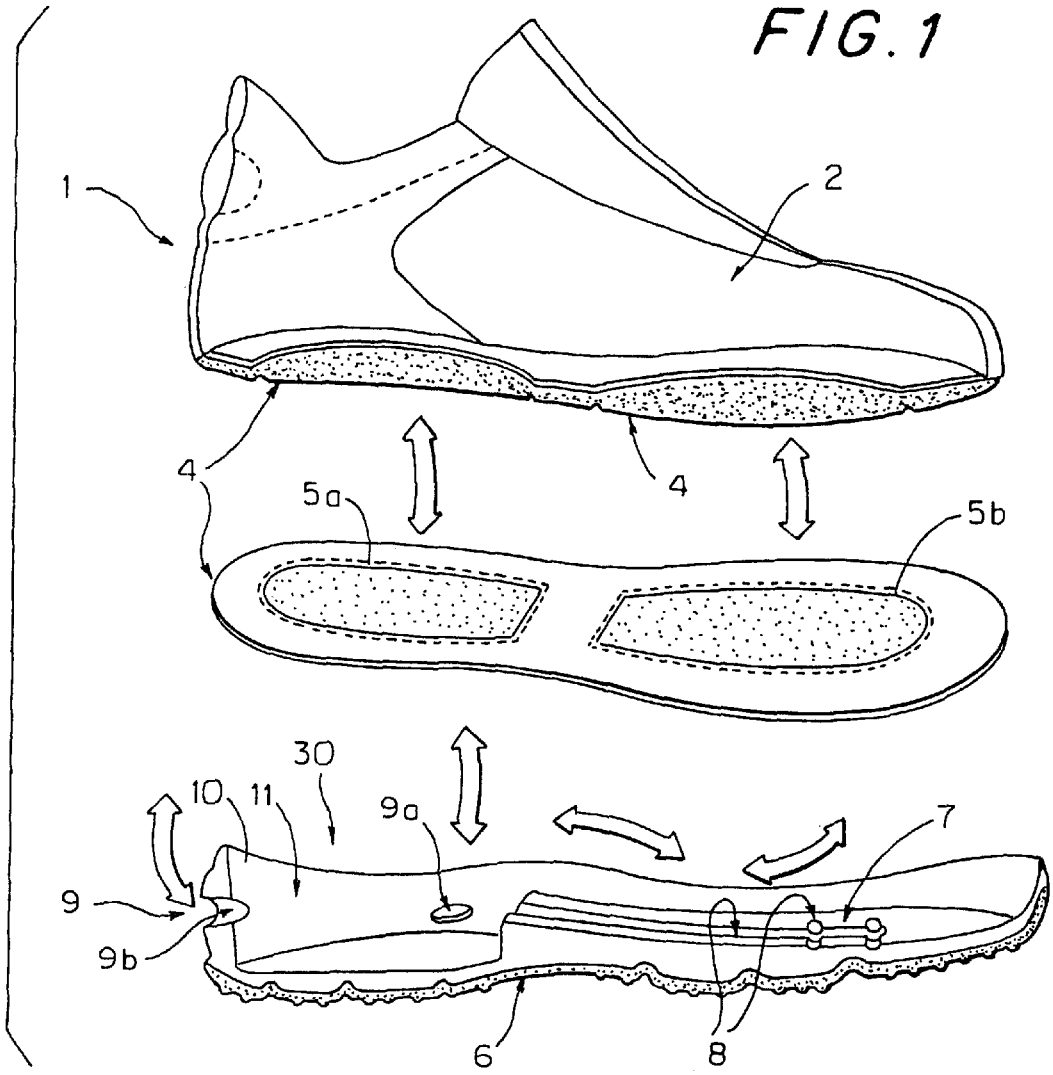
FIG. 1 shows, in an exploded view with some selected parts, a shoe comprising an upper, an arch support and a sole made in accordance with the present invention.
Figure 2:
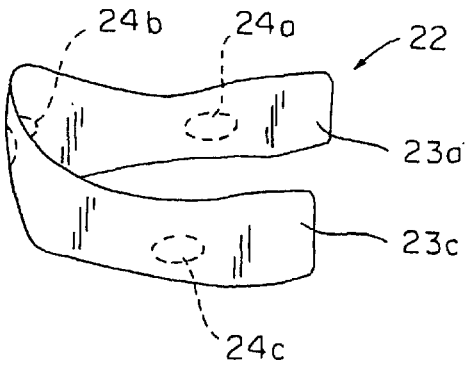
FIG. 2 shows a top perspective view of a gasket.
Figure 3:
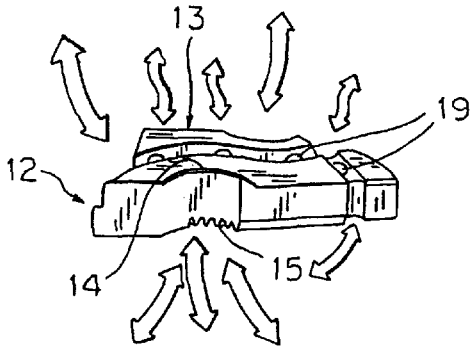
FIG. 3 shows a top perspective view of an insert.
Figure 4:
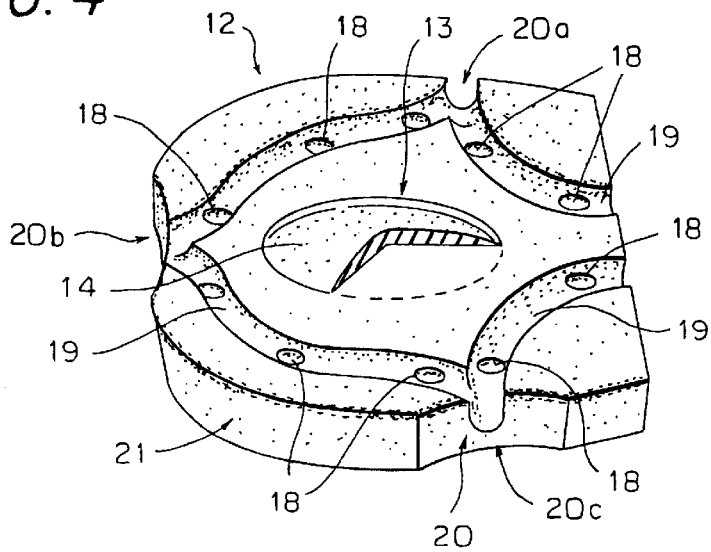
FIG. 4 shows a top perspective view of the upper surface of the insert of FIG. 3.
Figure 5:
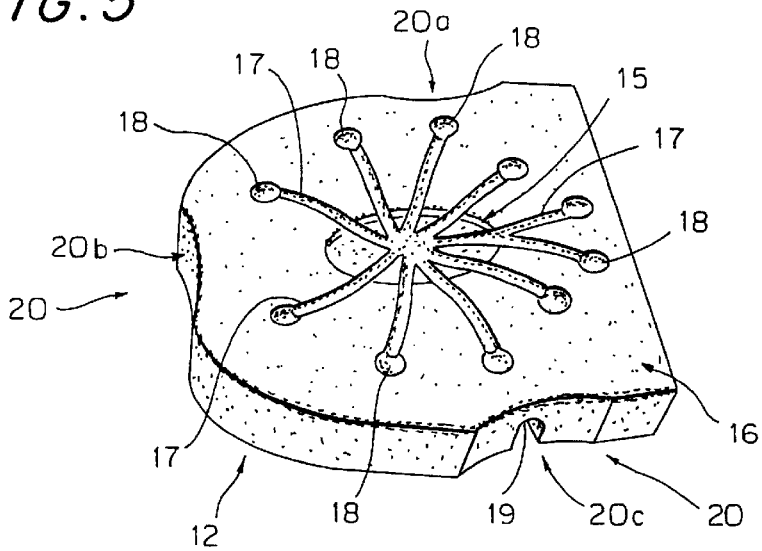
FIG. 5 shows a three-quarters view of the lower surface of the insert of FIG. 3.

The sole 6 further comprises an insert 12, as in FIGS. 4 and 5, and has, in the area 7 of the arch support and of the tip, first ducts 8, suitable for the circulation of air flows.

Figure 8:
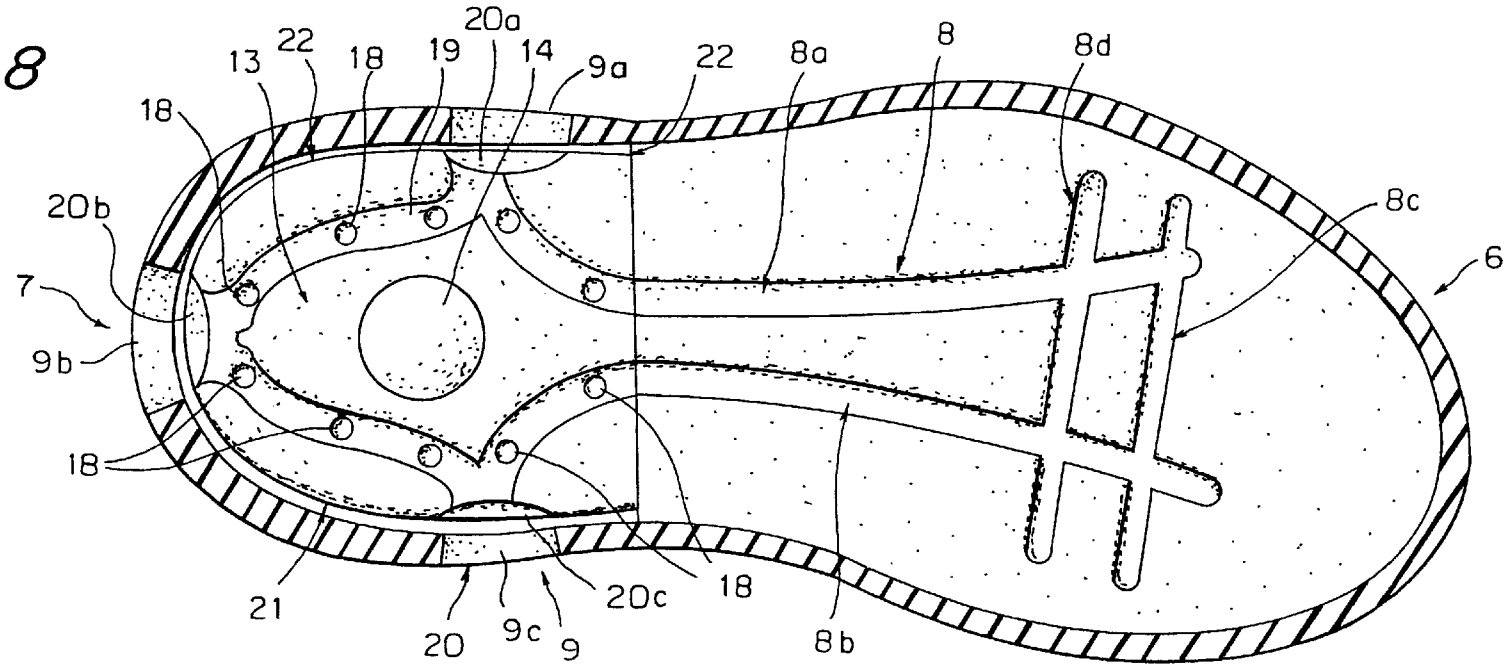
FIG. 8 shows a plan view of the sole of FIG. 7.

The first ducts 8 can be positioned and shaped in multiple ways; FIG. 8 shows a solution providing a first pair of first ducts 8*a* and 8*b*, positioned longitudinally and slightly diverging towards the tip of the sole and transversely joined by a second pair of first ducts 8*c* and 8*d* having also the function of facilitating the deformation of the sole 6 when the user is walking, thereby easing his/her ambulation.

Also obtained in the sole 6 are one or more openings 9, in this embodiment a first, a second and a third opening, indicated respectively with the numbers 9*a*, 9*b* and 9*c*, obtained for instance on the first lateral surface 10 of the sole 6, in posterior and lateral position, advantageously in correspondence with the heel.

These first, second and third opening 9*a*, 9*b* and 9*c* can have circular, oval, elliptical or lanceolate shape, and are able to place the interior of the shoe in communication with the exterior.

In the sole 6, preferably in correspondence with the area 30 of the heel, is also obtained a seat, indicated with the number 11, having box-like shape and open superiorly, for housing the insert 12, which is shaped counter to the seat 11 itself.

In correspondence with an upper surface 13 of the insert 12, and inferiorly to the first area 5*a*, a central area is advantageously obtained, indicated with the number 14, elastically compressible and opportunely shaped as a spherical dome, in such a way as to project superiorly to said upper surface 13 itself.

The central area 14 is inferiorly communicating with a cavity, indicated with the number 15, obtained on the lower surface 16 of the insert 12, in such a way that to a deformation of the central area 14 corresponds a variation of the volume of the cavity 15.

On the lower surface 16 of the insert 12 are obtained second ducts 17, which depart from said cavity 15, advantageously in the radial direction.

Each second duct 17 joins the cavity 15 to the respective hole 18, external to the cavity; said holes 18 pass vertically through the insert 12 in order to place in communication the second ducts 16 with respective appropriate third ducts 19.

The third ducts 19, also suitable for air circulation inside the sole 6, are obtained on the upper surface 13 in proximity to the central area 14 and are in communication both with the first ducts 8 and with a plurality of recesses 20 in this particular embodiment with a first, a second and a third recess, indicated with the numbers 20*a*, 20*b* and 20*c*.

The first, second and third recesses 20*a*, 20*b* and 20*c* are advantageously obtained on a second lateral surface, indicated with the number 21, of said insert 12.

The first, second and third recess 20*a*, 20*b* and 20*c* are shaped, in a plan view, as an arc of a circle, and are positioned respectively in correspondence with the first, second and third opening 9*a*, 9*b* and 9*c*.

Between the first lateral surface 10, located internally to said sole 6, and the second lateral surface 21 of the insert 12 is preferably positioned a gasket, indicated with the number 22, having approximately rectangular development and horse-shoe shape. The gasket is impermeable to water but not to air.

Figure 6:
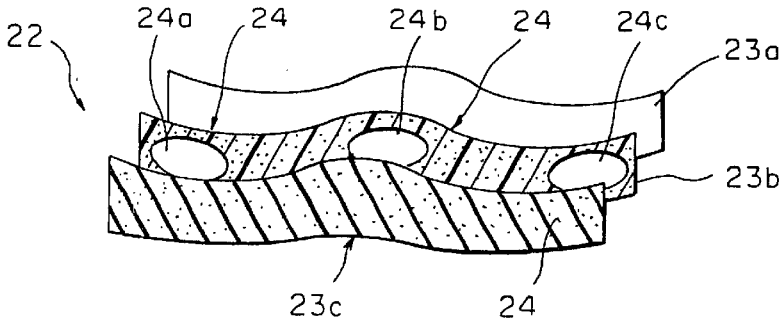
FIG. 6 shows an exploded view of the layers constituting the gasket of FIG. 2.

As shown in FIG. 6, said gasket 22 is advantageously constituted by a first, a second and a third layer, indicated with the numbers 23*a*, 23*b* and 23*c*, heat sealed together, for instance with high frequency electromagnetic waves.

The second layer 23*b* is conveniently constituted by thermoplastic material and has one or more openings 24, in this embodiment a fourth, a fifth and a sixth opening, indicated with the numbers 24*a*, 24*b* and 24*c*, in correspondence with said first, second and third opening 9*a*, 9*b* and 9*c*.

The first internal layer 23*a* is advantageously constituted by impermeable and transpiring fabric, such as material known with the trademark GORE-TEX; the third layer 23*c*, appropriately holed for air passage, can be constituted, for instance, by a mesh of plastic material such as polyvinylchloride, and serves a function of support and protection against possible impacts or rubbings against external elements.

Figure 7:
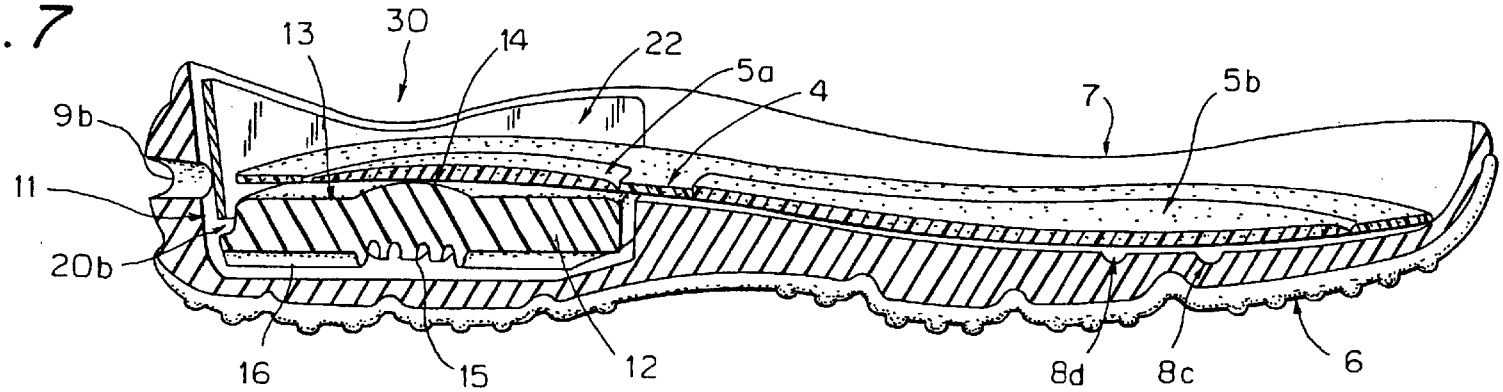
FIG. 7 shows a lateral section view of the sole in which are positioned the insert, the gasket and the arch support.

The operation of the sole 6 of the present invention therefore is as follows: with reference to FIG. 7, upon laying the heel down, the usere's weight causes the compression and hence the deformation of the central area 14, which consequently reduces the volume of the cavity 15.

The air contained in this cavity is thus forced to travel through the second ducts 17 and the through holes 18, in such a way as to reach the third ducts 19.

Thence, the air can circulate through the first ducts 8 or exit through the first, second and third openings 9*a*, 9*b* and 9*c*, passing through the first layer 23*a* made of GORE-TEX and the third layer 23*c*.

On the contrary, when the heel is raised off the ground and the weight is taken off the sole, the central area 14 returns to its non deformed configuration, causing an increase in the volume of the cavity 15.

The increase in the volume of the cavity 15 consequently causes a flow of air in the second and third ducts 17, 19 in opposite direction relative to the previous flow.

This flow of air can also come through the first ducts 8, thus aspirating the air from the interior of the shoe and through the first, the second and the third opening 9*a*, 9*b* and 9*c*, thus carrying external air inside the shoe.

It has thus been noted that the invention has reached its specified task and aims, a shoe having been devised that is provided with a sole that allows the exchange of air between the interior and the exterior of the shoe, thus obtaining an effective transpiration whilst maintaining the required characteristics of impermeability and ruggedness.

Naturally, the materials employed as well as the dimensions constituting the individual components of the invention may be more pertinent according to specific requirements.

What is claimed is:

1. Ventilated shoe sole structure able to be associated to an upper of a shoe, comprising:

an outsole having a bottom surface, a top surface, and a first surface, and a first lateral surface, said top surface having a rear heel area, a forefoot area and a central plantar arch area between said heel area and said forefoot area;

first ducts shaped as grooves and formed on said top surface from the heel area to the plantar arch and the forefoot areas;

a seat in said heel area;

one or more openings connecting the seat to an outside of the sole, each opening extending through the first lateral surface of said outsole in correspondence with the heel area;

an insert counter-shaped to said seat, having at least a central area elastically compressible and a cavity on a lower surface of the insert under said central area;

second ducts through said insert and extending from said cavity to an upper surface of said insert;

third ducts shaped as grooves, formed on the upper surface of said insert and communicating with said first ducts, said second ducts and said openings;

a gasket permeable to air but not to water interposed between said third ducts and said openings; and an insole disposed above said top surface of the outsole, and presenting one or more areas, formed of transpiring material, at least in correspondence with said first and third ducts permitting uniform diffusion of air inside the shoe.

2. Ventilated shoe sole structure as claimed in claim 1, wherein each of said second ducts comprises a first portion departing from said cavity and developing, radially from said cavity, on said lower surface of said insert, and a second portion passing vertically through said insert in order to place in communication said second ducts with said third ducts.

3. Ventilated shoe sole structure as claimed in claim 1, wherein said first ducts are constituted by a first pair of first ducts positioned longitudinally and slightly diverging towards the forefoot area and transversely joined by a second pair of said first ducts.

4. Ventilated shoe sole structure as claimed in claim 1, wherein one or more recesses are obtained on a second lateral surface of said insert each being positioned in correspondence with one of said openings.

5. Ventilated shoe sole structure as claimed in claim 4, wherein said first, second and third layer, are heat sealed to each other by high frequency electromagnetic waves.

6. Ventilated shoe sole structure as claimed in claim 1, wherein said central area of the insert is shaped as a spherical dome and projects upwardly from said upper surface of the insert.

7. Ventilated shoe sole structure as claimed in claim 6, wherein each of said second ducts comprises a first portion departing from said cavity and developing, radially from said cavity, on said lower surface of said insert, and a second portion passing vertically through said insert in order to place in communication said second ducts with said third ducts.

8. Ventilated shoe sole structure as claimed in claim 1, wherein said one or more openings comprise a first, a second and a third opening, each having circular, oval, elliptical or lanceolate shape, to allow communication of the interior of the shoe with the exterior.

9. Ventilated shoe sole structure as claimed in claim 8, wherein one or more recesses are obtained on a second lateral surface of said insert each being positioned in correspondence with one of said openings.

10. Ventilated shoe sole structure as claimed in claim 9, wherein said gasket is positioned between said first lateral surface, positioned internally to said sole, and said second lateral surface of said insert, said gasket presenting an approximately rectangular development, in plain view, and a horse-shoe shape.

11. Ventilated shoe sole structure as claimed in claim 8, wherein said gasket is constituted by a first, a second and a third layer, heat sealed to each other, said second layer being constituted by thermoplastic material and presenting one or more openings.

12. Ventilated shoe sole structure as claimed in claim 11, wherein said second layer presents a fourth, a fifth and a sixth opening, in correspondence with said first, second and third opening, provided on said sole.

13. Ventilated shoe sole structure as claimed in claim 1, wherein said gasket is constituted by a first, a second and a third layer, heat sealed to each other, said second layer being constituted by thermoplastic material and presenting one or more openings therein.

14. Ventilated shoe sole structure as claimed in claim 13, wherein said first internal layer is constituted by both impermeable and transpiring fabric.

15. Ventilated shoe sole structure as claimed in claim 13, wherein said third layer has holes for the passage of air, and is made of a mesh of plastic material.

16. Ventilated shoe sole structure as claimed in claim 15, wherein said mesh of plastic material is made of polyvinylchloride.

* * * * *